US005435692A

United States Patent [19]

Kidger et al.

[11] Patent Number: 5,435,692

[45] Date of Patent: Jul. 25, 1995

[54] PUMPS

[75] Inventors: John S. Kidger; Roger J. Cumming, both of Cheltenham; John C. Gibbons, Newent, all of Great Britain

[73] Assignee: Lucas Industries PLC, United Kingdom

[21] Appl. No.: 279,913

[22] Filed: Jul. 25, 1994

[30] Foreign Application Priority Data

Jul. 28, 1993 [GB] United Kingdom ..... 9315625

[51] Int. Cl.[6] ..... F04D 5/00

[52] U.S. Cl. ..... 415/55.4

[58] Field of Search ..... 415/55.1, 55.2, 55.4

[56] References Cited

U.S. PATENT DOCUMENTS 4,441,855 4/1984 Tayler ..... 415/55.2

FOREIGN PATENT DOCUMENTS 55-32909 3/1980 Japan ..... 415/55.2

2068461 8/1981 United Kingdom ..... 415/55.4

*Primary Examiner*—Edward K. Look

*Assistant Examiner*—Michael S. Lee

*Attorney, Agent, or Firm*—Jones & Askew

[57] ABSTRACT

A regenerative pump comprises a housing (1), an impeller (5) within the housing (1) having a plurality of vanes (13) spaced angularly around the axis of rotation of the impeller (5) and accommodated within a flow channel (4) within the housing (1) extending between an inlet (19) and an outlet (20), a flow stripper (17) located between the inlet (19) and outlet (20) and through which the vanes (13) pass, a fluid flow loop (27) in the stripper (17) which intersects the path of rotation of the vanes (13), and control means (26) to control the flow of fluid through the loop (27) so as to vary the annular motion transferred to the fluid downstream of the stripper (17), thereby to selectively vary the output of the pump. The flow stripper (17) comprises a land portion (21) upstream of the loop (27) which restricts direct fluid flow through the stripper (17), and the control means (26) comprises valve means which controls a supply of fluid to the upstream end of the loop (27). The supply of fluid to the loop (27) is tapped from a high pressure region of the pump possibly via a second fluid flow loop (22) in the stripper (17).

6 Claims, 3 Drawing Sheets

FIG. 3.
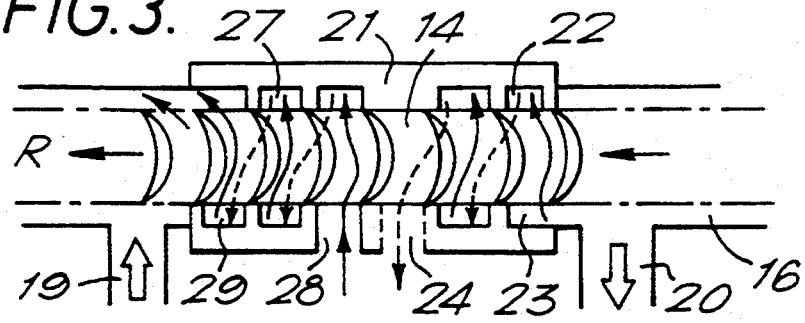
FIG. 4.
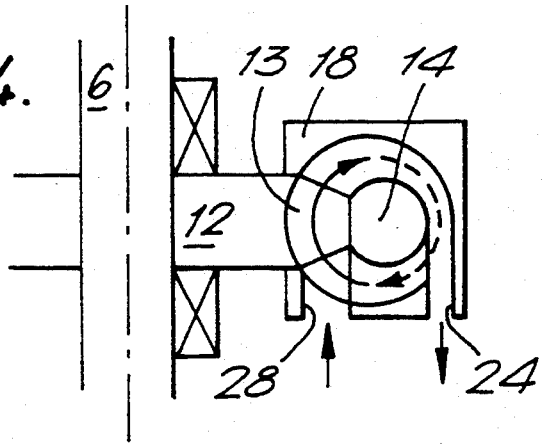
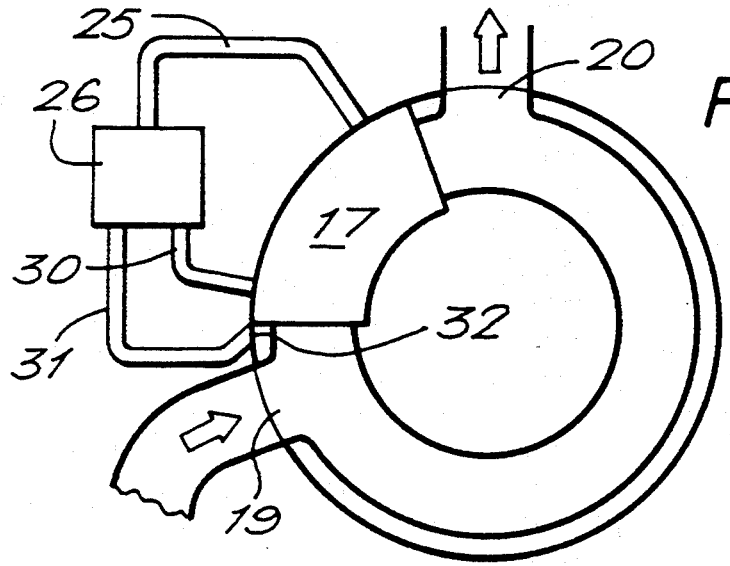
FIG. 5.

PUMPS

TECHNICAL FIELD

This invention relates to regenerative pumps.

Regenerative pumps comprise a housing with a fluid inlet and a fluid outlet, and an impeller rotatably mounted within the housing and having a plurality of vanes spaced angularly around the axis of rotation of the impeller and accommodated within a flow channel within the housing extending between the inlet and outlet, the vanes serving to induce a spiral or helical flow of fluid along the length of the flow channel as the impeller is rotated. The spiral flow is induced by the centrifugal and frictional effects of the vanes on the fluid and causes the fluid to be re-circulated repeatedly across a plurality of the vanes between the inlet and outlet, thereby progressively increasing the fluid pressure. A stripper block is located between the inlet and outlet and has sufficient clearance with the impeller and vanes to allow them to pass but to restrict direct fluid flow from the higher pressure fluid outlet to the lower pressure fluid inlet.

In a known type of regenerative pump, an annular core is provided in the flow channel and the fluid flows in said spiral path about the core. The vanes project from the impeller into the flow channel and either terminate just short of a fixed core or are connected to the core so that the core rotates with the rotor. The vanes may have an aerofoil or curved cross-section to enhance the fluid flow effects, and means may be provided to assist the initial spiral flow of fluid at the inlet. An example of such a regenerative pump is shown in British Patent No. 2068461.

British Patent No. 2074242 discloses a regenerative pump in which fluid flows in a spiral path about a core between an inlet and outlet, and which incorporates a stripper block between the inlet and outlet that serves to preserve the annular motion of the fluid as it passes with the vanes of the impeller through the stripper block. This is achieved by providing a fluid flow loop in the stripper block which intersects the path of the rotation of the vanes. The fluid flow loop may comprise one or more closed loops each of which is formed by a separate duct which re-circulates the fluid through the vanes, or may comprise a single quasi-helical loop formed by a succession of ducts between the outlet and inlet side of the stripper block. In the latter arrangement, the quasi-helical flow loop serves to preserve the annular motion of the fluid to a maximum extent so as to maintain increased pump efficiency and pressure rise.

Regenerative pumps of the aforesaid kind are mechanically simple and reliable and are capable of operating at high speed and have low specific weight. Regenerative pumps are also capable of generating high pressures, and high flows, the pressure generally being proportional to the square of the impeller speed, and the flow generally being proportional to the impeller speed. However, in some applications, for example, as engine driven fuel pumps for aviation gas turbine engines, this pressure/flow/speed characteristic can be a problem at some operating conditions. Thus a regenerative fuel pump may be designed to produce a desired fuel pressure and flow at low speed, engine light-up conditions, but the fuel pressure and/or flow at maximum engine speed may then be excessive, resulting in fuel heating and high delta T, because of the high energy input of the pump.

DISCLOSURE OF THE INVENTION

An object of the present invention is to provide a regenerative pump in which the aforesaid problem of excess pressure and/or excess flow at higher speed can be reduced or avoided.

According to the present invention, a regenerative pump comprises a housing with a fluid inlet and a fluid outlet, an impeller rotatably mounted within the housing and having a plurality of vanes spaced angularly around the axis of rotation of the impeller and accommodated within a flow channel within the housing extending between the inlet and outlet, a flow stripper located between the inlet and outlet and through which the vanes pass, and a fluid flow loop in the stripper which intersects the path of rotation of the vanes, characterised in that control means is provided to control the flow of fluid through the loop so as to vary the annular motion transferred to the fluid downstream of the stripper, thereby to selectively vary the output of the pump.

Preferably, the flow stripper comprises a land portion upstream of the loop which is adapted to restrict direct fluid flow through the stripper, and the control means comprises valve means which controls a supply of fluid to the upstream end of the loop independently of any direct leakage flow through the stripper.

The supply of fluid to the loop may conveniently be tapped from a high pressure region of the pump.

In one embodiment, the supply of fluid is tapped from a point within the stripper which is upstream of the land portion and is in communication with the outlet end of the flow channel. A second fluid flow loop in the stripper may connect the outlet end of the flow channel to said fluid supply tapping. The valve control means may then operate to switch the fluid supply from said tapping to the first loop or to a dump point within the pump.

DESCRIPTION OF THE DRAWINGS

The invention will now be described by way of example with reference to the accompanying drawings in which:

FIG. 3 is a schematic drawing showing the operation of the flow stripper of the pump in FIG. 1;

FIG. 4 is a schematic drawing showing the operation of the flow stripper of the pump in FIG. 1;

FIG. 5 is a schematic side view of the pump of FIGS. 1 to 4 showing the external fluid connections for the flow loop in the stripper block;

MODE OF CARRYING OUT THE INVENTION

Figure 2:
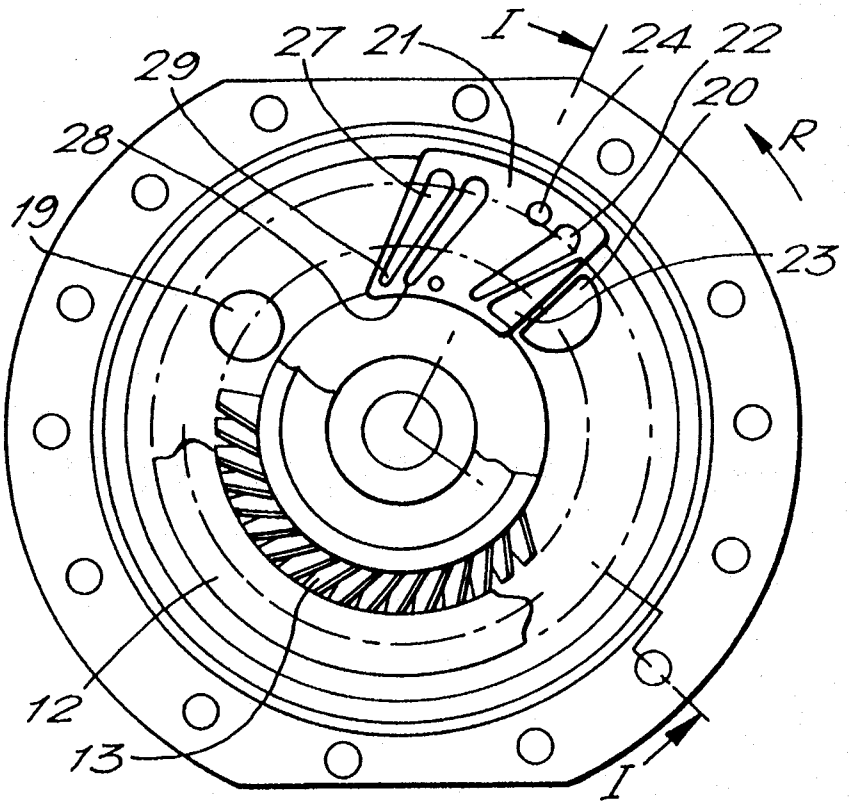
FIG. 2 is a schematic view of the inner face of the left hand section of the pump housing in FIG. 1.
Figure 1:
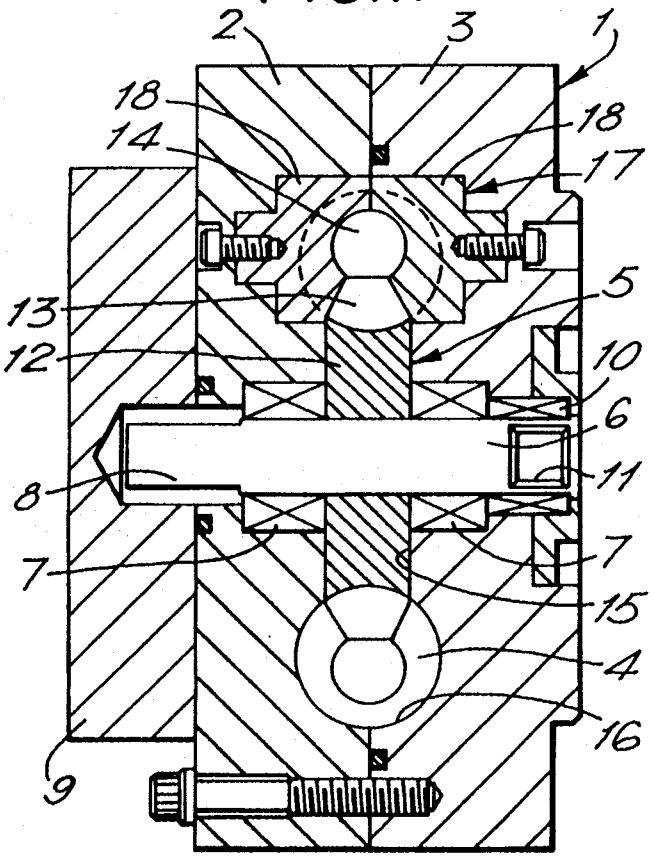
FIG. 1 is a schematic section on the line I—I in FIG. 2 through a regenerative pump according to the invention.

The regenerative pump illustrated in FIGS. 1 to 4 comprises a housing 1 formed in two sections 2, 3 which are connected face-to-face and define an internal cavity 4 therebetween to receive an impeller 5 which is mounted on a drive shaft 6 supported in the housing by combined journal and thrust bearings 7. One end of the shaft 6 is received in a blind bore 8 in an end plate 9, and the other end of the shaft 6 is sealed in the housing by a mechanical shaft seal 10 and is formed with internal splines 11 for driving connection to a power source.

The impeller 5 comprises an inner annular body 12 and an outer toroidal ring 14 with a plurality of radially projecting curved section vanes 13 connected therebetween. The body 12 of the impeller 5 is a close fit with the inner walls 15 of the cavity 4 in the housing 1, but the vanes 13 and toroidal ring 14 project radially into an enlarged peripheral portion of the cavity 4 in the form of a toroidal chamber 16 concentric with the shaft 6 and symmetrical with the impeller 15 about the radially extending dividing plane along which the housing sections 2,3 meet.

A flow stripper block 17 is located within the toroidal chamber 16 and comprises a pair of blocks 18 which are secured in opposed recesses in the housing sections 2,3 and have inner faces which cooperate to closely surround the vanes 13 and the toroidal ring 14, as shown in FIGS. 3 and 4. An inlet port 19 is provided in the housing section 2 so as to open into the toroidal chamber 16 adjacent to the downstream side of the stripper block 17, given that the impeller 15 rotates in the direction of arrow R, as shown in FIG. 2. An outlet port 20 is provided in the housing section 2 so as to open into the toroidal chamber 16 adjacent to the upstream side of the stripper block. The chamber 16 between these inlet and outlet ports 19,20 forms a flow channel in which the impeller induces a helical flow of fluid about the toroidal ring 14 as it is rotated, passing repeatedly through the vanes 13 and being progressively raised in pressure.

The flow stripper block 17 serves to separate the high pressure outlet end of the flow channel 16 from the lower pressure inlet end of the flow channel 16 and limits the direct flow of fluid between the two. An intermediate portion 21 of the stripper block forms an annulus or land which is a close fit with the toroidal ring 14 and the vanes 13. On each side of this land portion 21, the inner surface of the stripper block is formed with a helical flow channel or loop 22 or 27 which advances in the same sense as the helical fluid flow about the toroidal ring 14 in flow channel 16.

On the upstream side of the land portion 21, the helical flow loop 22 opens into the outlet end of the flow channel 16 at a shaped port 23, and terminates at its other end at a bleed port 24 adjacent to the land portion 21. In operation, the helical flow of fluid in the flow channel 16 is collected by the shaped port 23 and conducted through the loop 22 to the bleed port 24, from which it is conducted via an external bleed connection 25 to a diverter valve 26 (see FIG. 5).

On the downstream side of the land portion 21, the helical loop 27 extends from a fluid supply port 28 adjacent to the land portion, to a shaped exit port 29 at its other end which directs the flow of fluid from the loop 27 circumferentially of the toroidal ring 14 through the blades 13 into the inlet end of the flow channel 16. The fluid supplied to the loop 27 therefore flows in a helical path through the loop and tends to continue in the same helical path within the flow channel 16 after leaving the exit port 29. This circumferentially directed jet of fluid from the exit port 29-therefore tends to induce a helical flow of fluid in the region of the inlet port 19, and thereby serves to enhance the pressure rise in the flow channel 16 caused by the repeated passage of the fluid through the vanes 13.

The supply of fluid to the supply port 28 of loop 27 is obtained via an external connection 30 from the diverter valve 26. The diverter valve 26 has two settings, in one of which (shown in FIG. 6) it connects the bleed connection 25.to the connection 30 so that the fluid from the upstream loop 22 is supplied to the supply port 28 of the downstream loop 27. In its other setting (shown in FIG. 7), the diverter valve 26 connects the bleed connection 25 to an external dump connection 31 which delivers the fluid from the upstream loop 22 to a dump port 32 (see FIG. 5) that opens into the flow channel 16 downstream of the stripper block 17. Thus, the downstream loop 27 is cut-off from its supply of fluid and has no effect in enhancing the helical flow of fluid in the region of the inlet port 19.

Figure 6:
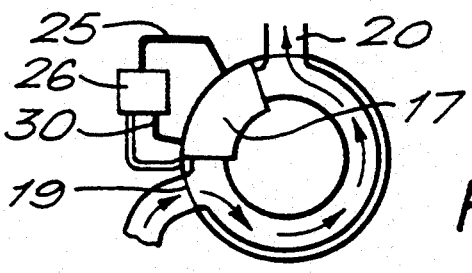
FIGS. 6 and 7 are similar to FIG. 5 but each shows a different setting of the control means of the flow loop.
Figure 7:
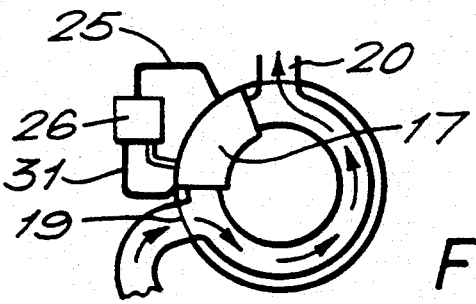
Figure 8:
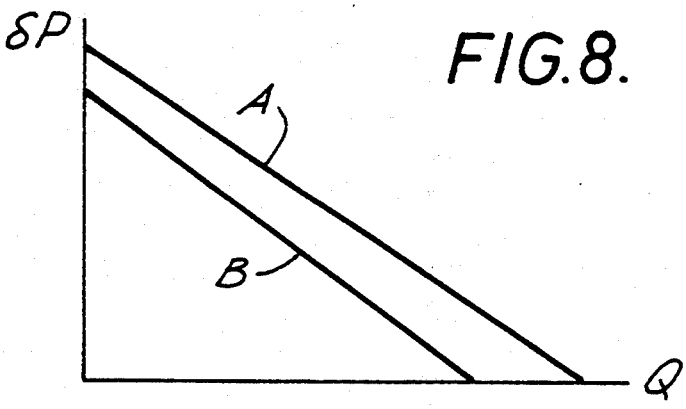
FIG. 8 is a graph showing the pump characteristic of pressure rise $\delta P$ and flow Q for the different control settings of FIGS. 6 and 7.

The effect of the two settings of the diverter valve 26 on the fluid output of the pump is illustrated by curves A and B in FIG. 8, which shows the pressure difference $\delta P$ between the inlet and outlet ports 19,20 of the pump against the fluid flow Q. Curve A shows the output of the pump when the diverter valve 26 connects the fluid from loop 22 to loop 27, as shown in FIG. 6, whilst curve B shows the output of the pump when the diverter valve 26 connects the fluid from loop 22 through connection 31 to the dump port 32 in the flow channel 16, as shown in FIG. 7. In the latter case, there is a reduction in both the pressure difference $\delta P$ and fluid flow Q, with the reduction in fluid flow Q being greatest at lower values of the pressure difference $\delta P$.

In all of the embodiments described above, the particular outputs produced by the pump will depend upon the relative position of the inlet and outlet 20 along the length of the flow channel 16. However, an improved output is obtained if the inlet 19 is spaced downstream of the stripper block 17, as shown in FIG. 2, rather than being located immediately after the stripper block. This downstream spacing of the inlet 19 may serve to allow the helical flow of fluid from the exit port 29 to establish itself before it meets the flow through the inlet 19. However, if the downstream spacing is too large the helical flow may dissipate and, for a fixed position of the outlet port 20, the effective length of the flow channel 16 will be reduced,. An optimum position of the inlet 19 lies within the range 15° to 90° downstream of the exit port 29, or the preferred range 45° to 75° downstream of the exit port 29.

We claim:

1. A regenerative pump comprising a housing defining a fluid inlet and a fluid outlet with a flow channel extending between the inlet and outlet, an impeller rotatably mounted within the housing and having a plurality of vanes spaced angularly around the axis of rotation of the impeller within the flow channel, a flow stripper through which the vanes pass between the outlet and inlet which defines a fluid flow loop which intersects the path of rotation of the vanes and control means to control the flow of fluid through said loop so as to vary the annular motion transferred to the fluid downstream of the stripper, thereby to selectively vary the output of the pump.

2. A pump as claimed in claim 1 in which the flow stripper comprises a land portion upstream of the loop which is adapted to restrict direct fluid flow through the stripper, and the control means comprises valve means which controls a supply of fluid to the upstream end of the loop independently of any direct leakage flow through the stripper.

3. A pump as claimed in claim 2 in which the supply of fluid to the loop is tapped from a tapping in a high pressure region of the pump.

4. A pump as claimed in claim 3 in which said tapping is in a region of the stripper which is upstream of the land portion and is in communication with the outlet end of the flow channel.

5. A pump as claimed in claim 4 in which a second fluid flow loop in the stripper connects the outlet end of the flow channel to said tapping.

6. A pump as claimed in claim 1 in which the control means operates to switch said supply of fluid between the first loop and a dump point within the pump.

* * * * *